US007574982B2

(12) United States Patent
Blackburn

(10) Patent No.: US 7,574,982 B2
(45) Date of Patent: Aug. 18, 2009

(54) ENGINE CYCLES

(76) Inventor: Anthony Edgar Blackburn, 34 Hastings Road, Southport, Merseyside (GB) PR8 2LW ( * ) Notice: Subject to any disclaimer, the term of this patent is extended or adjusted under 35 U.S.C. 154(b) by 0 days.

(21) Appl. No.: 11/075,345

(22) Filed: Mar. 9, 2005

(65) Prior Publication Data

US 2005/0252460 A1 Nov. 17, 2005

(30) Foreign Application Priority Data

May 13, 2004 (GB) ..... 0410657.1

(51) Int. Cl.
*F02B 69/06* (2006.01)

(52) U.S. Cl. ..... 123/21; 123/90.11

(58) Field of Classification Search ..... 123/21, 123/64, 90.11, 198 F, 22, 302, 308
See application file for complete search history.

(56) References Cited

U.S. PATENT DOCUMENTS 5,050,557 A * 9/1991 Ishida et al. ..... 123/432
5,553,580 A * 9/1996 Ganoung ..... 123/308
5,598,819 A * 2/1997 Blackburn ..... 123/302
5,762,041 A * 6/1998 Fraidl et al. ..... 123/308
6,443,108 B1 * 9/2002 Brehob et al. ..... 123/64
6,523,504 B2 * 2/2003 Miura ..... 123/21
6,612,285 B2 * 9/2003 Ganoung ..... 123/308
6,619,241 B2 * 9/2003 Otterspeer et al. ..... 123/21
6,848,403 B2 * 2/2005 Litorell ..... 123/90.16
6,971,338 B2 * 12/2005 Kobayashi et al. ..... 123/21
7,334,564 B2 * 2/2008 Blackburn ..... 123/302
2005/0205027 A1 * 9/2005 Lewis et al. ..... 123/90.11

FOREIGN PATENT DOCUMENTS

GB 2445415 * 7/2008

* cited by examiner

*Primary Examiner*—Hai H Huynh

(57) ABSTRACT

An 8 Stroke and 4 Stroke cycle change engine where alternate 'air only' inductions are used under half load provided by alternate opening inlet valves operated by Electro-Magnetic, Electro-Hydraulic or other electrically controlled means and where the electronic control of the inlet valves can also open all inlet valves on all induction strokes to deliver more power in 4 stroke mode. The electronic control also allows for different inlet valve timings for each adjacent fuel/air 4 Stroke cycle and the next 'air only' 4 Stroke cycle. Electronic control of the inlet valve timing also allows an 'air only' inlet valve to open and admit air during an induction stroke when a fuel/air inlet valve also opens thus admitting a larger volume of air to give increased power in the fuel efficient alternate 'air only' 8 Stroke mode.

6 Claims, 1 Drawing Sheet

ENGINE CYCLES

BACKGROUND

Simple mechanical camshafts for internal combustion engines provide fixed valve timings. More complex valve gear can give variable valve timings to improve both the power output and fuel efficiency from 4 stroke engines. However, the amount of variation with mechanical valve gear is limited. Electronically controlled inlet valves allow any valve to open or close at any point in any cycle managed by microprocessors or computers and software.

Building on my previous Patents particularly GB EP 0578637, FR EP 0578637, DE 69107311.2-08 U.S. Pat. No. 5,598,819, and U.S. application Ser. No. 10/870,297 improved fuel efficiency and power output can now be achieved with Blackburn Cycle otherwise known as 8 Stroke and 4 Stroke Cycle Change Engines or 'Cool Charge' with the use of electronically controlled inlet valves.

Figure 1:
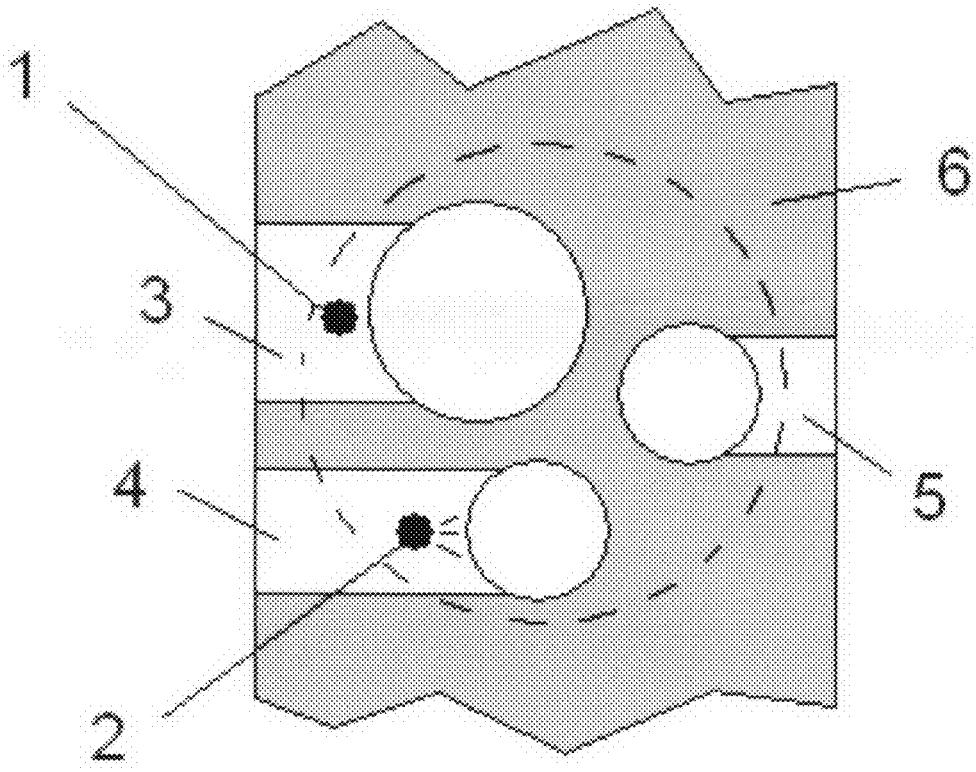
FIG. 1/1 shows a section through an engine cylinder head 6 which includes exhaust port 5, larger 'air only' inlet port 3, and smaller fuel/air inlet port 4. Fuel injector 2, in the fuel/air inlet port 4, injects fuel on alternate induction strokes. Fuel injector 1, in the 'air only' inlet port 3, is switched off for the fuel efficient 8 Stroke mode but switched on for alternate induction strokes when higher power 4 Stroke mode is required. Electronically controlled valve actuators (not shown) open and close the inlet valves as specified. The same electronically controlled valve actuator for port 4 can also vary the opening and the quantity of fuel/air induction, in place of a usual throttle.

An electronically controlled valve actuator (not shown) opens port 3 fully for alternate 'air only' inductions, in the fuel efficient 8 Stroke mode. This same actuator can also open this valve and port to admit more air in the fuel efficient 8 stroke mode when the smaller fuel/air port 4 is open. This increases the power available in the fuel efficient 8 stroke mode. The Exhaust valve in port 5 can be opened by a usual cam or an electronically controlled valve actuator (not shown).

DESCRIPTION

There is provided an 8 Stroke and 4 Stroke cycle change engine where alternate 'air only' inductions are used under half load provided by alternate opening inlet valves operated by Electro-Magnetic, Electro-Hydraulic or other electrically controlled means.

Electronic control of the valves can also open all inlet valves on all induction strokes to deliver more power in 4 stroke Electronic control of the inlet valve timing also allows for different inlet valve timings for each adjacent fuel/air 4 Stroke cycle and the next 'air only' 4 Stroke cycle.

Electronic control of the inlet valve timing also allows an 'air only' inlet valve to open and admit air during an induction stroke when a fuel/air inlet valve also opens thus admitting a larger volume of air to give increased power in the fuel efficient alternate 'air only' 8 Stroke mode.

One version of the 8 Stroke and 4 Stroke Cycle Change Engine with mechanical valve gear has alternate acting inlet valves. One inlet valve is used for fuel/air inductions and the other for the alternate 'air only' inductions when in 8 Stroke mode for cruising and idling. The mode is changed to 4 Stroke for higher power by switching on a fuel injector in the 'air only' inlet so that all 4 stroke cycles then have fuel/air. However, only one of the two inlet valves open for each induction stroke which limits the engine breathing and power output. Electro-Magnetic, Electro-Hydraulic or other electrically controlled inlet valves can open at any time. Both inlet valves can then open together to increase breathing and the maximising power output. When less power is needed the inlet valves can change to open for alternate 4 stroke cycles only. One inlet valve admits fuel/air for the first 4 Stroke cycle then the second inlet valve admits 'air only' for the next 4 stroke cycle, this being an 8 Stroke Cycle or the Blackburn Cycle.

Usual variable valve timing tries to optimise the valve timings for a particular speed and load and then maintains these timings for several cycles. Electronic valve control permits different valve timings for adjacent 4 Stroke cycles while in 8 Stroke mode. The optimum timings for the fuel/air 4 stroke cycle may be different to the adjacent 'air only' 4 Stroke cycles.

25% load in 8 Stroke mode can be used as an example. 25% load requires 50% of a full load combustion on alternate 4 stroke to average at 25% load. The electronically controlled inlet valve(s) opens fully to admit fuel/air mixture for the first half of this induction stroke only. The inlet valve(s) then closes for the second half of this induction stroke. However, the alternate 'air only' inductions benefit from maximising each intake of 'air only'. The inlet valve(s) for the 'air only' inductions opens fully for the whole induction stroke, while the preceding and following fuel/air 4 stroke cycles require the inlet valve(s) to close after the first half of the induction stroke only.

If 20% combustion is required the fuel/air inlet valves would open for approximately the first 20% of the induction stroke. If 60% combustion is required the fuel/air inlet valve (s) open for the first 60% of this induction stroke, etc. etc. The mechanical work done by the piston expanding the cylinder contents after the inlet valves have closed is largely recovered as the partial vacuum in the cylinder lifts the piston to aid crankshaft rotation for the first part of the 'Compression' stroke.

There is little or no vacuum during the inlet valve fully open period. There is no need for a throttle. This is mechanically more efficient than throttling the fuel/air inlet charge which causes larger pumping losses. When in 8 Stroke mode adjacent 4 Stroke cycles can have different inlet valve timings using electronically controlled valves. However, adjacent cycles can also have the same inlet valve timings, for example when half total load is needed, which is full load in 8 Stroke mode. Both fuel/air and 'air only' inlet valves then open fully for all respective induction strokes. A further feature of Electronic inlet valve control can be incorporated on '8 Stroke' engines. Where there are two inlet valves in an engine cylinder, the valves themselves are usually the same size. However, advantages can be gained by using electrically controlled inlet valves of equal or unequal size in each cylinder as follows:—

A main feature of the '8 Stroke' or 'Cool Charge' engine is alternate 'air only' inductions in each cylinder under half load. It is important to maximise the intake of the cool 'air only' for each alternate induction. Simply increasing the size of this 'air only' inlet valve naturally achieves this objective. However, increasing the size of the 'air only' inlet valve leaves less space in the cylinder head for the other fuel/air inlet valve which must then be smaller. But with independent electronic control of both inlet valves this need not restrict the maximum power when the smaller fuel/air inlet valve is used in '8 Stroke' mode.

When maximum power is needed in the fuel efficient '8 Stroke' mode, the smaller fuel/air inlet valve will open fully. However, the larger 'air only' inlet valve can also open during this induction stroke, to maximise the induction air. Increased fuel from the smaller fuel/air inlet valve is then needed to maintain the optimum fuel/air ratio from both inlet valves. This is achieved without quantities of fuel/air mixture entering the 'air only' inlet and passing unburned through the engine during the 'air only' 4 stroke part of the 8 Stroke cycle.

There can of course be more than one fuel/air or 'air only' inlet valves. A possible layout might be one 'fuel/air' inlet valve and two 'air only' inlet valves per cylinder all of the same size for simplicity and cost reduction with one or more usual exhaust valves.

Electronic control of the inlet valves allows both a greater intake of 'air only' when the 8 Stroke cycle requires this and a greater intake of fuel/air when this is required by using a smaller fuel/air inlet valve plus the larger 'air only' inlet valve. More power can then be delivered in the fuel efficient 8 Stroke cycle with alternate 'air only' inductions. An odd number of cylinders is needed to give evenly spaced firing impulses in both alternate 'air only' induction and 4 Stroke modes.

The invention claimed is:

1. A 4 Stroke cycle change engine where a usual 4 Stroke cycle is extended to 8 strokes, when less than half load is needed, by adding 'air only' induction, 'air only' compression, 'air only' expansion and 'air only' exhaust strokes between usual combustion 4 stroke cycles provided by alternate opening fuel/air and 'air only' inlet valves operated by Electro-Magnetic, Electro-Hydraulic or other electrically controlled means and where the electronic control of the inlet valves also opens all inlet valves on all induction strokes to deliver maximum power in 4 stroke mode, the control also provides different inlet valve timings for adjacent fuel/air inlet strokes and the intervening 'air only' inlet strokes for steady loads less than full load in both 4 stroke and 8 stroke modes.

2. An engine as claimed in claim 1 where electronic control of the inlet valve timing also allows an 'air only' inlet valve to open and admit air during an induction stroke when a fuel/air inlet valve also opens thus admitting a larger volume of air to give increased power in the fuel efficient alternate 'air only' 8 Stroke mode.

3. An engine as claimed in claim 1 where the fuel/air inlet valve is smaller than the 'air Only' inlet valve.

4. An engine as claimed in claim 1 where electronically controlled inlet valves allow any valve to open or close at any point in any cycle managed by microprocessors or computers and software.

5. An engine as claimed in claim 1 where an odd number of cylinders gives evenly spaced firing impulses in both alternate 'air only' induction 8 stroke mode and 4 Stroke mode.

6. An engine as claimed in claim 1 where the fuel/air inlet valve opens fully for part of an induction stroke and closes as early as possible when less than a full fuel/air intake is needed for low power.

* * * * *